US005085609A

United States Patent [19]

Haberle

[11] Patent Number: 5,085,609

[45] Date of Patent: Feb. 4, 1992

[54] PUPPET THEATER WITH SOUND TRACK AND CUED LIGHTS

[76] Inventor: Walter Haberle, Gronauer Weg 16, Bad Vilbel, Fed. Rep. of Germany, 6368

[21] Appl. No.: 495,426

[22] Filed: Mar. 19, 1990

[30] Foreign Application Priority Data

Nov. 25, 1989 [DE] Fed. Rep. of Germany ... 8913920[U]

[51] Int. Cl.[5] ..... A63J 19/00

[52] U.S. Cl. ..... 446/83; 446/80; 272/10

[58] Field of Search ..... 446/80, 81, 71, 82, 446/83, 84; 272/9, 10, 11, 21, 22, 23

[56] References Cited

U.S. PATENT DOCUMENTS

| | | | |
|---|---|---|---|
| 1,332,253 | 3/1920 | Holloway | 446/83 |
| 1,583,775 | 5/1926 | Brandt | 446/82 |
| 1,874,819 | 8/1932 | Simmons | 446/84 |
| 2,071,044 | 2/1937 | Savage | 272/10 X |
| 2,166,572 | 7/1939 | Staudt | 446/83 X |
| 2,725,230 | 11/1955 | Weintraub | 272/10 |
| 4,137,665 | 2/1979 | Bierwiler | 446/83 |
| 4,560,359 | 12/1985 | Wilson et al. | 446/83 X |
| 4,764,142 | 8/1988 | Griffith et al. | 446/82 |
| 4,804,348 | 2/1989 | Bondi | 446/352 X |
| 4,857,028 | 8/1989 | Pail | 446/82 |
| 4,917,373 | 4/1990 | Bourne et al. | 272/9 |

FOREIGN PATENT DOCUMENTS

| | | | |
|---|---|---|---|
| 2298353 | 8/1976 | France | 446/82 |
| 444755 | 3/1936 | United Kingdom | 446/71 |

*Primary Examiner*—David N. Muir

*Attorney, Agent, or Firm*—Wegner, Cantor, Mueller & Player

[57] ABSTRACT

A puppet theater with a playback device (7) for sounds provided during a theatrical performance has an electrically actuatable display (13, 14, 15) for each puppet to be used. Control signals are recorded on the sound medium (7') of the playback device (7), and include display controls to trigger the displays to cue the puppeteer during the performance as to which puppet is to be used at a given time in the script. The control signals of the playback device can also include automatic commands for unwinding a backdrop (5), and signals for controlling the illumination of colored lamps (16, 17, 18) which light the stage.

20 Claims, 1 Drawing Sheet

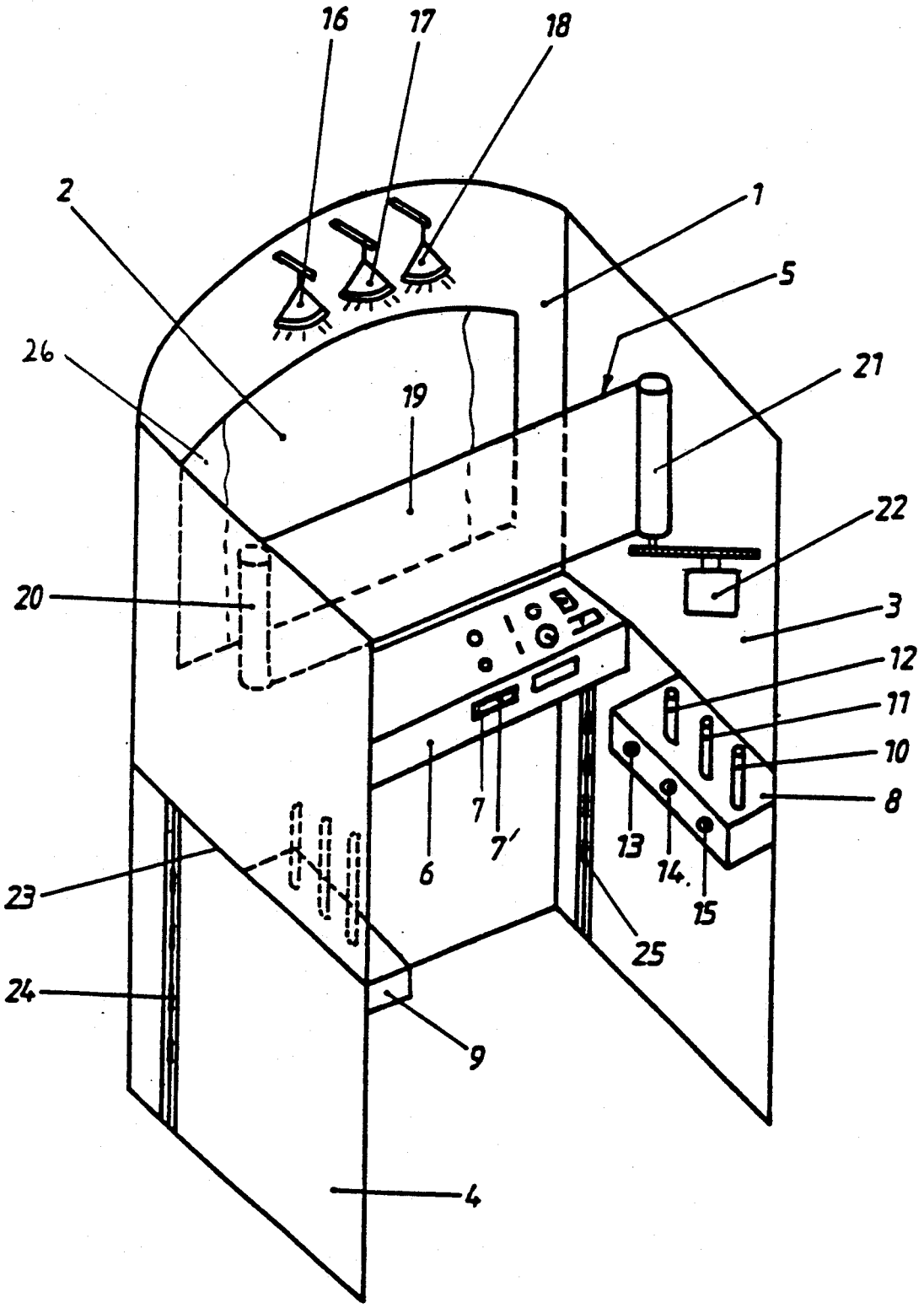
16
17
18
2
1
5
26
19
21
22
20
3
12
11
10
8
7
7'
6
13
14
15
23
25
24
9
4

PUPPET THEATER WITH SOUND TRACK AND CUED LIGHTS

BACKGROUND OF THE INVENTION

This to a puppet theater with several puppets to be used in performance and with a playback device, for example for noises provided during a theatrical performance. Such puppet theaters are generally known and in common use.

Puppet theaters are frequently used by laypeople in the home environment. In such cases it is advantageous if the performer can be offered as many aids as possible for the execution of the performance. For example, during the performance one can run a tape on which background noises and the dialogue of the employed puppets have been recorded. Nevertheless, the theatrical performance demands considerable skill, because different puppets must be used in synchronization with the sound playback.

SUMMARY OF THE INVENTION

An object of the invention is to configure a puppet theater of the initially stated type in such a way that execution of a play is as simple as possible even for laypeople.

This object is achieved in accordance with the invention by providing a number of electrically actuatable displays for the puppet to be used in each case, corresponding to the number of puppets to be used in the theatrical performance, and by providing control signals to trigger the displays recorded on the sound medium of the playback device.

By means of this design the performer always recognizes in a timely way, from the displays controlled by the playback device, when he has to employ a new puppet. For that reason the execution of the theatrical performance is particularly simple, and late entrances of puppets, not to mention the use of the wrong puppet, are ruled out.

The displays might be configured on the puppet theater's control desk in the form of illuminated numbers, if corresponding numbers are assigned to the puppets. The theatrical performance is facilitated if the displays are provided on or at a holder for the puppets to be used during the performance.

The display is configured particularly simply if it is formed of an electric lamp in each case.

The theater in accordance with the invention can be conveniently transported by the performer, and consequently easily used—for example in kindergartens—if all its parts are arranged in a carrying case which, in the unfolded, opened-up state, forms a stage with side walls, a control desk with the playback device, and the holder for the puppets.

The control signals are preferably recorded on the sound medium of the playback device, on an additional track of the tape.

However, it is also possible that the control signals on the playback device's tape may be acoustic signals, and that each of the displays may present a sound sensor.

In addition to the displays for the puppets to be used in each case, in accordance with a further, advantageous configuration of the invention the sound medium may also actuate additional lamps, if additional control signals to control lamps that illuminate the stage are recorded on the sound medium.

It is particularly advantageous to provide a red lamp, a blue lamp and a yellow lamp as the lamp means, and to provide lamp control commands to trigger each of the lamps with any desired brightness. The three lamps make it possible to light the stage in any desired color, by causing the three lamps to burn at different brightnesses, so that any desired mixture of colors can be obtained. Thus for example one can not only very readily produce evening light, but also a stormy atmosphere or lightning Folding up the puppet theater into a portable carrying case is very easily accomplished if the puppet theater presents a horizontal dividing joint at approximately one-half its height, if the upper halves of the side walls are foldable forward against the upper half of the front wall, and the upper half of the front wall is foldable forward and downward against the lower half of the front wall, and if the lower halves of the side walls are configured to be foldable inward against the lower half of the front wall.

The backdrop can be changed very quickly from one background scene to another if the backdrop is formed of two motor-driven winding rollers, on which a scenery strip with different background scenes is rolled up. With such a scenery strip, one can also produce the impression of a snowstorm or fog.

It contributes toward the further facilitation of the theatrical performance if control commands for the drive of the winding/rollers are provided as part of the control signal mean on the sound medium.

In another preferred embodiment of the invention additional control commands are recorded on the sound medium to trigger additional mechanisms in the puppet theater, such as a curtain.

The invention permits numerous embodiments. To clarify its basic principles further, one of these is shown schematically in the drawing and is described below.

BRIEF DESCRIPTION OF THE DRAWING

The figure schematically shows a view of a preferred embodiment of the puppet theater in accordance with the present invention.

DESCRIPTION OF PREFERRED EMBODIMENTS

The shown puppet theater has a front wall I, in which an opening is provided as a stage 2. The front wall 1 is held in its shown upright position by side walls 3, 4. The side walls 3, 4 are connected to the front wall with hinges or means for folding in such a way that the puppet theater as a whole can be folded up into a portable carrying case.

Behind the stage 2, a backdrop 5 is provided between the side walls 3, 4, and is so configured that the performer can see the audience through it, but is himself invisible to the audience. Below the stage 2 is a control desk 6 in which a playback device 7, for example a tape deck, is accommodated. Both side walls have supports 8, 9, which in this preferred embodiment have upward-pointing pegs, which form holders 10, 11, 12 for the puppets to be used. In front of each holder 10, 11, 12, a display 13, 14, 15 is provided in the form of a lamp.

On the sound medium 7′ such as a tape in the playback device 7, acoustic control signal means are recorded on an additional soundtrack, which include display control means for causing each of the displays 13, 14, 15 to light up as desired. Each of the displays 13, 14, 15 preferably includes a sound sensor. In this way the puppet performer is cued or signaled at the proper points in the plot as to which puppet he must use just then.

The figure further shows lamp means including three electric lamps 16, 17, 18 above the stage 2, the first of which can emit red light, the second blue light and the third yellow light. These lamps 16, 17, 18 are also preferably controlled by control signal means recorded on the sound medium 7' of the playback device 7. Thus it is possible to trigger each of the lamps 16, 17, 18 independently of the others and to control the brightness of the respective lamp 16, 17, 18 automatically by acoustic lamp signal means.

The backdrop 5 consists of a scenery strip 19 which is rolled on two rollers 20, 21 arranged on either side of the stage 2. The winding roller 21 can be driven by a motor 22 which in turn can be triggered by the control signal means from the playback device 7. If the winding roller 21 turns clockwise, the scenery strip 19 is unrolled from the unwinding roller 20 and rolled up on the winding roller 21. In this way a stage setting can be changed automatically.

The ability of the puppet theater to fold up can be achieved in various ways. In the embodiment shown, a horizontally running dividing joint 23 is provided at approximately half the height of the puppet theater. The upper halves of the side walls 4 can be folded forward against the front wall 1. Then the upper half of the front wall 1 can be folded downward against the lower half of the front wall 1. The lower halves of the side walls 3, 4 can be folded inward on hinges 23, 25. In the resulting clear space between the folded-in lower halves of the side walls and the lower half of the front wall, a drawer can be installed.

In a preferred embodiment, curtain control commands are recorded on the sound medium 7' comprising the control signal means, so that the opening and closing of curtains 26 can be automatically controlled.

The provision of additional acoustic triggers in the control signal means on the sound medium 7' to automatically operate other mechanisms and features of a puppet theater is within the purview of the artisan.

What is claimed is:

1. A puppet theater for use in a performance with a plurality of puppets, including a front wall having a stage, a side wall at each vertical side of said front wall, and a playback device having a sound medium, the improvement comprising: a plurality of electrically actuable displays including one said display for each of said plurality of puppets; and control signal means comprising display control means for triggering each said display, wherein said control signal means are recorded on the sound medium of said playback device.

2. A puppet theater according to claim 1, the improvement further comprising a puppet holder for each said puppet, wherein each said display is correspondingly located on or adjacent to each said puppet holder.

3. A puppet theater according to claim 2, the improvement further comprising at least one support means at one said side wall for supporting said puppet holders, wherein said displays are located on said support means.

4. A puppet theater according to claim 3, the improvement further comprising a control desk at said front wall accommodating the playback device, and a foldable carrying case means for portably arranging the contents of the puppet theater when folded and for forming the side walls and the front wall having the stage for performance when unfolded.

5. A puppet theater according to claim 4, wherein the foldable carrying case means comprises a horizontal joint approximately dividing each said wall into an upper half and a lower half whereby the upper halves of the side walls are foldable forward against the upper half of the front wall and the upper half of the front wall is foldable forward and downward against the lower half of the front wall, and means for folding the lower halves of the side walls inward against the lower half of the front wall.

6. A puppet theater according to claim 1 wherein each said display comprises an electric lamp.

7. A puppet theater according to claim 1, the improvement further comprising a control desk at one said wall accommodating the playback device, and a foldable carrying case means for portably arranging the contents of the puppet theater when folded, and for forming the side walls and the front wall having the stage for performance when unfolded.

8. A puppet theater according to claim 7, wherein the foldable carrying case means comprises a horizontal joint approximately dividing each said wall into an upper half and a lower half, whereby the upper halves of the side walls are foldable forward against the upper half of the front wall and the upper half of the front wall is foldable forward and downward against the lower half of the front wall and means for folding the lower halves of the side walls inward against the lower half of the front wall.

9. A puppet theater according to claim 1, wherein said sound medium of the playback device comprises a separate sound track on which said control signal means are recorded, said separate sound track being in addition to sound tracks on which any theatrical background noises and dialogue for the performance are recorded.

10. A puppet theater according to claim 1, wherein said display control means are acoustic signals, and each said display includes a sound sensor.

11. A puppet theater according to claim 1, the improvement further comprising lamp means for illuminating the stage, said control signal means further comprising lamp signal means for controlling the illumination of said lamp means.

12. A puppet theater according to claim 11, wherein said lamp signal means includes means for controlling the brightness of said lamp means.

13. A puppet theater according to claim 12, wherein said lamp means includes a red lamp, a blue lamp and a yellow lamp, and said lamp signal means includes means for individually controlling the illumination and brightness of each said lamp.

14. A puppet theater according to claim 1, the improvement further comprising a backdrop means for providing scenery behind the stage during a performance, said backdrop means comprising a an unwinding roller and a winding roller vertically oriented o opposite sides of the stage, a scenery strip arranged to be unrolled from said unwinding roller and rolled on said winding roller, and drive means for driving the winding roller.

15. A puppet theater according to claim 14, wherein the control signal means further comprises roller command means for controlling said drive means.

16. A puppet theater according to claim 15, wherein said sound medium of the playback device comprises a separate sound track on which said control signal means are recorded, said separate sound track being in addition to sound tracks on which any theatrical background noises and dialogue for the performance are recorded.

17. A puppet theater according to claim 15, the improvement further comprising lamp means for illuminating the stage said control signal means further comprising lamp signal means for controlling the illumination of said lamp means.

18. A puppet theater according to claim 17, the improvement further comprising at least one support means at one said side wall supporting a plurality of puppet holders, wherein said displays are correspondingly located on said support means.

19. A puppet theater according to claim 18, the improvement further comprising a control desk at said front wall accommodating the playback device, and a foldable carrying case means for portably arranging the contents of the puppet theater when folded and for forming the side walls and the front wall having the stage for performance when unfolded.

20. A puppet theater according to claim 1, the improvement further comprising a curtain on the stage, said control signal means further comprising curtain signal means for controlling opening and closing of the curtain.

* * * * *